US007077658B1

(12) United States Patent
Ashman et al.

(10) Patent No.: US 7,077,658 B1
(45) Date of Patent: Jul. 18, 2006

(54) ANGLED COMPLIANT PIN INTERCONNECTOR

(75) Inventors: John J. Ashman, Murrells Inlet, SC (US); Monroe N. Waymer, Orangeburg, SC (US)

(73) Assignee: AVX Corporation, Myrtle Beach, SC (US)

( * ) Notice: Subject to any disclaimer, the term of this patent is extended or adjusted under 35 U.S.C. 154(b) by 0 days.

(21) Appl. No.: 11/029,923

(22) Filed: Jan. 5, 2005

(51) Int. Cl.
*H01R 12/00* (2006.01)

(52) U.S. Cl. ..... 439/65

(58) Field of Classification Search ..... 439/65, 439/75, 82
See application file for complete search history.

(56) References Cited

U.S. PATENT DOCUMENTS

| | | | | | |
|---|---|---|---|---|---|
| 3,437,882 | A | * | 4/1969 | Cayzer | 361/791 |
| 3,596,235 | A | * | 7/1971 | Teurlings | 439/748 |
| 3,899,231 | A | * | 8/1975 | Bray | 439/80 |
| 4,533,203 | A | * | 8/1985 | Feldman et al. | 439/64 |
| 4,632,475 | A | * | 12/1986 | Tomita | 439/1 |
| 4,693,529 | A | * | 9/1987 | Stillie | 439/67 |
| 4,900,258 | A | * | 2/1990 | Hnatuck et al. | 439/63 |
| 5,078,612 | A | | 1/1992 | Rozmus | |
| 5,090,912 | A | * | 2/1992 | Zell | 439/79 |
| 5,151,056 | A | | 9/1992 | McClune | |
| 5,237,742 | A | | 8/1993 | McClune | |
| 5,518,427 | A | | 5/1996 | Kan et al. | |
| 5,567,167 | A | * | 10/1996 | Hayashi | 439/75 |
| 5,754,796 | A | * | 5/1998 | Wang et al. | 710/301 |
| 5,761,050 | A | | 6/1998 | Archer | |
| 5,865,648 | A | | 2/1999 | Clyatt, III | |
| 5,879,188 | A | | 3/1999 | Clyatt | |
| 6,042,423 | A | | 3/2000 | Murr et al. | |
| 6,077,128 | A | | 6/2000 | Maag et al. | |
| 6,309,228 | B1 | | 10/2001 | Otsuki et al. | |
| 6,345,990 | B1 | * | 2/2002 | Hyzin | 439/79 |
| 6,350,131 | B1 | * | 2/2002 | Shih | 439/65 |
| 6,592,382 | B1 | * | 7/2003 | Wurster | 439/82 |
| 6,623,280 | B1 | * | 9/2003 | Oldenburg et al. | 439/75 |
| 6,733,301 | B1 | * | 5/2004 | Brown, III | 439/65 |
| 6,802,720 | B1 | | 10/2004 | Weiss et al. | |
| 6,808,397 | B1 | * | 10/2004 | Kondo | 439/76.2 |
| 6,918,775 | B1 | * | 7/2005 | Korsunsky et al. | 439/65 |
| 2001/0046817 | A1 | | 11/2001 | Putnam | |
| 2003/0092296 | A1 | | 5/2003 | Oldenburg et al. | |
| 2003/0114027 | A1 | * | 6/2003 | Wurster | 439/82 |
| 2003/0199195 | A1 | | 10/2003 | Koehler et al. | |

(Continued)

*Primary Examiner*—Ross Gushi
(74) *Attorney, Agent, or Firm*—Dority & Manning

(57) ABSTRACT

An angled compliant pin connector is provided, comprising an insulative housing and a plurality of press fit pins. Each said pin includes a first leg and a second leg, the legs joining to define a V-shape. One or both such legs may define an aperture therethrough, the apertures at least partially bounded by resilient walls. The press fit pins are carried by the insulative housing side-by-side generally parallel one to another, the first legs of the pins projecting from the insulative housing to provide a first attachment bed for connection to a first printed circuit board, the second legs of the pins projecting from the insulative housing to provide a second attachment bed for connection to a second printed circuit board, the two circuit boards residing in intersecting planes. The insulative housing may also include one or more mounting arms for bracing of a printed circuit board, and the mounting arms also may carry press fit pins for attachment to such printed circuit boards.

28 Claims, 4 Drawing Sheets

U.S. PATENT DOCUMENTS

2004/0018757 A1 1/2004 Lang et al.
2004/0019408 A1* 1/2004 del Puerto et al. ..... 700/245
2004/0029408 A1 2/2004 Brown, III
2004/0127071 A1 7/2004 Weiss et al.
2004/0166704 A1 8/2004 Perrigini et al.
2004/0198075 A1* 10/2004 Tanabe ..... 439/65

* cited by examiner

ANGLED COMPLIANT PIN INTERCONNECTOR

FIELD OF THE INVENTION

The presently disclosed technology relates to apparatuses for electrically connecting two printed circuit boards. In particular, the presently disclosed technology relates to an interconnector including compliant pins for electrically connecting printed circuit boards in an angular orientation one to the other.

BACKGROUND OF THE INVENTION

Printed circuit boards may be electrically interconnected in a stacked or layered configuration, each board parallel to another. For advantageous reasons, however, interconnecting such circuit boards in a non-parallel arrangement, one board at an angular orientation to another, may be desired in certain applications.

Currently known methods for such angularly-oriented interconnection, such as ball grid arrays or land grid arrays, may not be ideal in all applications. Solderless connections, for example, may be preferred in some situations. Additionally, or alternatively, in some situations it may be desirable for an interconnector not only to provide for electrical connection but also for reliable and strong mechanical connection between the two circuit boards. Still further, an interconnection that may be easily disassembled, and, optionally, reassembled may be preferred. In addition, certain applications, and certain manufacturers of electronic components, may benefit from the use of press fit assembly of printed circuit board interconnections. In providing for the foregoing features, an interconnector for angularly-oriented printed circuit boards must nevertheless maintain sufficient and reliable electrical contact, must conserve space, and must provide for rapid assembly time.

The presently known interconnectors do not optimally resolve such challenges.

While various implementations of circuit board interconnecting devices have been developed, no design has emerged that encompasses the desired characteristics as hereafter presented in accordance with the subject technology.

SUMMARY OF THE INVENTION

In view of the limitations encountered in the presently known technology and addressed by the present subject matter, an interconnecting device is disclosed directed toward providing for attachment of angularly-oriented printed circuit boards that makes use of press fit, compliant pins.

In accordance with aspects of certain embodiments of the present subject matter, an angled compliant pin connector is provided that may include at least two press fit pins, each such pin including a first leg and an opposed second leg. The first leg resides on a first axis and the second leg on a second axis, the two axes intersecting to define an angle of predetermined degree. The degree of such angle may either be a right angle or any obtuse angle. Each such leg of such a press fit pin defines a length, and each such leg defines therethrough at least one eyelet along that length. So configured, the press fit pins are carried in an insulative housing parallel one to another, the first legs of each such pin extending from the housing to provide a first attachment bed for electrical devices, and the second such legs of such pins extending from the housing to provide a second attachment bed for electrical devices.

In accordance with additional aspects of other embodiments of the present technology, at least two of the press fit pins may be electrically conductive. Still further, each of the eyelets defined through the leg of a respective pin may be resilient in at least one direction. Each such leg of such press fit pin may also terminate in a nib.

In accordance with yet additional aspects of the present technology, a first leg of at least one of the press fit pins may define two or more eyelets along the length of such leg.

In accordance with still further aspects of the present technology, the insulative housing may further include a mounting arm. Additionally, in accordance with the present technology, the insulative housing may include a second mounting arm, the first and second arms parallel one to the other. In accordance with yet still further aspects of the present technology, the insulative housing may include as an alternative to, or in addition to, the foregoing-described single mounting arm, or the foregoing-described first and second mounting arms, a third and fourth mounting arms, the third and fourth mounting arms residing at an acute angle one to the other. The present technology may also include at least one press fit pin carried by at least one of such mounting arms.

In accordance with another embodiment of the present subject matter, a plurality of elongated press fit pins may be provided, at least one of which is electrically conductive. Each such press fit pin is V-shaped, and including a first end and an opposed second end. Each such pin may define a first eyelet disposed proximate to the first end and a second eyelet disposed proximate to the second end, the first and second eyelets resilient in at least one dimension. Such elongated press fit pins are carried by an insulative housing and are disposed generally parallel one to another, with the first ends of the pins external to the insulative housing to define a first attachment plane and with the second ends of the pins external to the insulative housing to define a second attachment plane, the first and second attachment planes intersecting.

In accordance with additional aspects of other embodiments of the present technology, the V-shaped pins may each define a right angle. Alternatively, in other embodiments, the V-shaped pins may define an obtuse angle.

In accordance with yet additional aspects of the present technology, each of the first and second legs of the press fit pins may terminate in a nib. Alternatively, or additionally, one leg of at least one of such press fit pins may define a second eyelet therethrough.

In accordance with still further aspects of the present technology, the insulative housing may include a mounting arm. Alternatively, the insulative housing may include both a first mounting arm and a second mounting arm, the first and second mounting arms parallel one to another. Alternatively, or additionally, the insulative housing may include a third and fourth mounting arms, the third and fourth mounting arms residing one to the other at an angle of predetermined degree, the predetermined degree being a right angle or an acute angle. A press fit pin may be carried by any or all such mounting arms, depending upon the embodiment utilized.

In accordance with another embodiment of the present technology, a plurality of elongated press fit pins are provided, each such pin including a first leg and a second leg, the first and second legs joining to define a V-shape with a midpoint at such juncture, each such leg terminating in a nib.

The first leg may define a first aperture therethrough distal to the midpoint, and the second leg likewise may define a second aperture therethrough distal to the midpoint, the first and second apertures at least partially bound by resilient walls. The press fit pins are carried by an insulative housing, the insulative housing defining a length and having a generally polygonal cross-section along that length. So configured relative to such insulative housing, the press fit pins may be disposed side-by-side generally parallel one to another, the first legs of the pins projecting from the insulative housing to expose the first apertures to define a first attachment plane, and the second ends of the pins projecting from the insulative housing to expose the second apertures to define a second attachment plane, the first and second said such attachment planes intersecting.

In accordance with an additional aspect of the present technology, the V-shape defined by the first and second legs of the press fit pins may define a right angle. Alternatively, the V-shape of the press fit pins may define an obtuse angle.

In accordance with yet additional aspects of the present technology, the first leg of at least one of the press fit pins may define a second eyelet therethrough.

In accordance with still further aspects of the present technology, the insulative housing may include a first mounting arm. Still further, a second mounting arm may be included in addition to the first mounting arm, the first and second mounting arms parallel one to another. Alternatively, or additionally, the insulative housing may include a third and fourth mounting arms, the third and fourth mounting arms residing one to the other at an angle of predetermined degree, either a right angle or an acute angle. Optionally, in either configuration, at least one of such first, second, third, or fourth mounting arms may carry a press fit pin.

In accordance with another embodiment of the present technology, a plurality of V-shaped press fit pins is provided, each pin including a first leg and a second leg, the first leg including resilient connecting means for connecting the leg to a throughhole of an electrical device, the second leg including resilient connecting means for connecting the second leg to a throughhole of an electrical device. Housing means are provided for housing the press fit pins side-by-side generally parallel one to another, with the resilient connection means of the first and second legs projecting from the housing means.

In accordance with an additional aspect of the present technology, the V-shape of the press fit pins may define a right angle. Alternatively, in another embodiment, the V-shape may define an obtuse angle.

In accordance with yet additional aspects of the present technology, a first leg of at least one such press fit pin may include a second resilient connecting means.

In accordance with yet still further aspects of the present technology, the housing means may include mounting means for mounting the housing means on a circuit board.

Additional objects and advantages of the present subject matter are set forth in the appended drawing and in the detailed description below, or will be apparent to those of ordinary skill in this technology. It should be further appreciated that modifications and variations to specific features and elements may be practiced in various embodiments and uses of the invention without departing from the spirit and scope of the subject matter. Variations might include, but are not limited to, substitution of equivalent means, features, or aspects for those that are illustrated, referenced, or discussed herein, as well as the functional, operational, or positional reverse of various parts, features, aspects, or the like.

It is to be understood that different embodiments, as well as different presently preferred embodiments of the present subject matter may include various combinations or configurations of the presently disclosed features, elements, or aspects, or their equivalents, including combinations of features, parts, or aspects, or configurations thereof, that are not expressly shown in the figures or stated in the detailed description.

Additional embodiments of the present subject matter, not necessarily expressed in the summarized section, may include or incorporate various combinations of aspects of features, components, or aspects referenced in the summarized subjects above, and/or other features, components, or aspects as otherwise discussed in this application. Those of ordinary skill in the art will better appreciate the features and aspects of such embodiments, and others, upon review of the remainder of this specification.

BRIEF DESCRIPTION OF THE DRAWINGS

A full and enabling disclosure of the present invention, including the best mode thereof, directed toward one of ordinary skill in the art, is set forth in the specification, which makes reference to the appended figures. It should be noted that the appended drawings are not necessarily to scale in all instances, but may have exaggerated dimensions in some respects to illustrate the principles of the technology.

DETAILED DESCRIPTION

Figure 1:
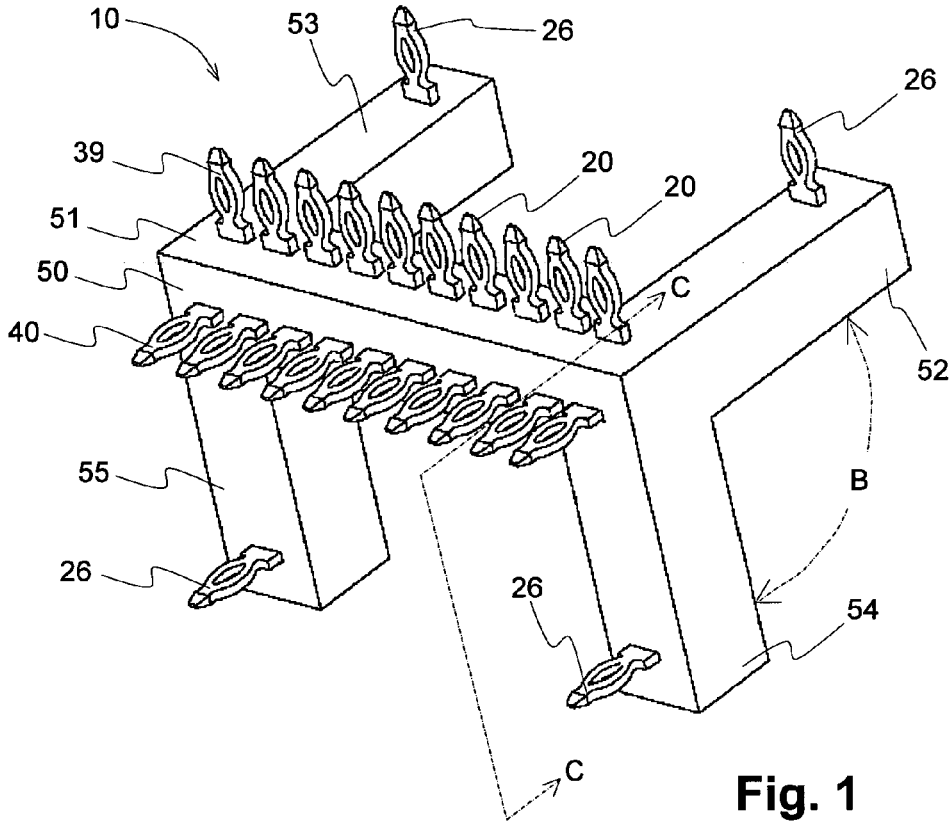
FIG. 1 is a perspective view of an angled compliant pin interconnector in accordance to certain aspects of the present invention, with fastening pins included on each of four mounting arms.

Reference will now be made in detail to the presently preferred embodiments of the present technology, one or more examples of which are illustrated in the drawings. Each example is provided by way of explanation of the technology, and is not meant as a limitation.

Repeat use of reference characters throughout the present specification and the appended drawings is intended to represent the same or analogous features or elements of the technology.

With reference to FIGS. 1 and 2, an angled compliant pin interconnector, generally 10, is provided. Interconnector 10 includes an insulative housing, generally 50, and a plurality of press fit pins 20. Interconnector 10 is configured for press fit assembly attachment of angularly-oriented printed circuit boards. Using press fit pins 20, solderless electrical and mechanical connections between two angularly-oriented printed circuit boards may be achieved, and such connections may be disassembled and, optionally, reassembled.

Insulative housing 50 is nonconductive, such as a thermoset or thermoplastic polymer.

Figure 2A:
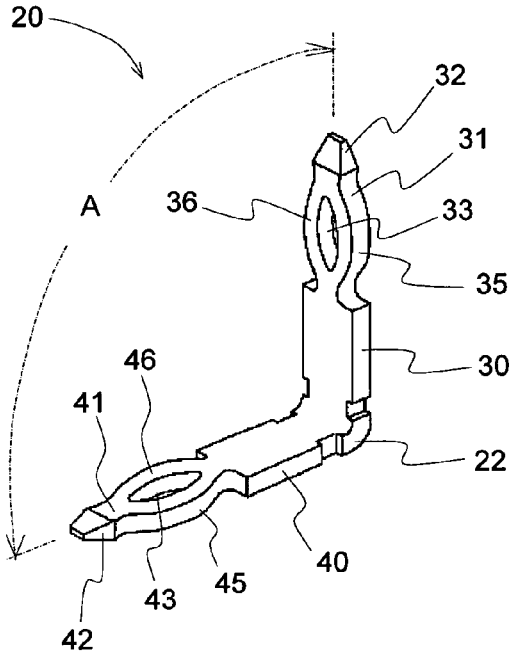
FIG. 2A is a perspective view of a V-shaped press fit pin with a single eyelet on each leg, in accordance with certain aspects of the present invention.

As illustrated in FIG. 2A, each press fit pin 20 includes a first leg 30 and a second leg 40. The first leg 30 and second leg 40 are disposed relative to each other to reside at angle A between them. As such, press fit pin 20 may be carried by the main body 51 of insulative housing 50 such that first leg 30 projects outboard of main body 51, and second leg 40 projects outboard of main body 51, the two respective legs thereby disposed for attachment to two separate printed circuit boards residing in non-parallel planes.

Press fit pins 20 all may be conductive, or some in a given application may selectively be chosen to be nonconductive for advantageous reasons of specific situations (such as for mechanical attachment only). If conductive, press fit pins 20 may be of phosphor bronze, beryllium copper, nickel, beryllium, stainless steel, or other electrical conductors. Press fit pins may be nonplated, or plated with nickel, tin, tin lead, gold, or silver.

As shown in FIG. 1, insulative housing 50 carries a plurality of press fit pins 20 in side-by-side generally parallel alignment. Accordingly, insulative housing 50 thereby provides a bed of plural first legs 30, each residing in generally parallel alignment and configured for attachment to plural receiving structures upon a first circuit board, as will be explained in more detail below. Correspondingly, a bed of plural second legs 40 likewise projects from insulative housing 50, the plural second legs 40 similarly adapted for attachment to plural receiving structures of a second printed circuit board. Because of the angular configuration of press fit pin 20, with its first and second legs residing one to the other at angle A, the first and second circuit boards to be attached to angled compliant pin interconnector 10 will reside in separate, intersecting planes.

With particular reference to FIG. 2A, it is to be understood that press fit pin 20 may include a resiliency-providing structure, such as a first eyelet 33 defined within first leg 30. First eyelet 33 is bounded, at least in part, by opposing walls 35, 36. Opposing walls 35, 36 are configured to provide resiliency upon deformation of eyelet 33 upon insertion in a receiving structure of a circuit board. Further, first leg 30 may terminate at first end 31 in a guiding structure, such as nib 32. Nib 32, which may be a beveled, sharpened, chamfered, or rounded point, provides for easier insertion of first end 31 into a receiving structure of a circuit board. Similarly, second leg 40 includes second eyelet 43, second eyelet 43 bounded by walls 45, 46. Walls 45, 46 are configured for resiliency upon deformation of second eye 43. Likewise, second leg 40 terminates at second end 41, which may include nib 42. Nib 42 may be configured similarly to nib 32, to provide for ease of insertion of second end 41 into a receiving structure of a separate circuit board.

Press fit pin 20 may also include at the juncture of first leg 30 and second leg 40 a mid-point flange 22. Mid-point flange 22 may be included for ease of fabrication of angled compliant pin interconnector 10, either during molding of main body 51 about a plurality of press fit pins 20, or during insertion of a plurality press fit pins 20 into main body 51. Mid-point flange 22 may also be used to provide securement of a press fit pin 20 within main body 51.

In one embodiment, angle A of press fit pin 20 may be a right angle, to provide for angularly-oriented interconnection of printed circuit boards in a perpendicular configuration. Alternatively, in another embodiment, angle A of press fit pin 20 may be an obtuse angle, to provide for interconnection of printed circuit boards at an acute angle, one to another, as will be explained below in greater detail with reference to FIG. 7. It should be understood that any predetermined angle may be utilized, to suit a particular application.

Returning to FIG. 1, an embodiment is illustrated that includes first mounting arm 52 and second mounting arm 53 extending from main body 51. Mounting arms 52, 53 may be employed to provide increased structural integrity as bracing for a circuit board that is connected to first legs 30 of the plurality of press fit pins 20. Correspondingly, angled compliant pin interconnector 10 may include third mounting arm 54 and fourth mounting arm 55, for increased integrity between two circuit boards interconnected with angled compliant pin interconnector 10, mounting arms 54, 55 providing bracing for a circuit board interconnected with the plurality of second legs 40 of the plurality of press fit pins 20. It will be appreciated that the nomenclature third mounting arm 54 and fourth mounting arm 55 need not necessarily require also that first mounting arm 52 and second mounting arm 53 be included; instead, mounting arms 54, 55 are referred to, respectively, as "third" and "fourth" only for ease of understanding within this specification as differentiating between first mounting arm 52 and second mounting arm 53.

Figure 5:
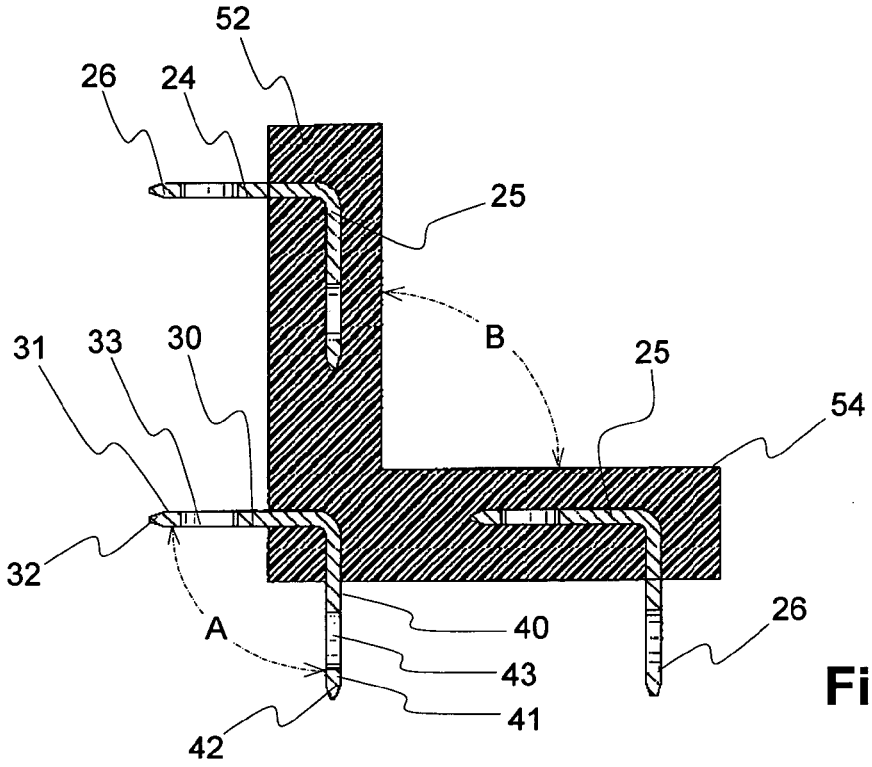
FIG. 5 is a cross-sectional view taken along line C—C in FIG. 1.

Still with reference to FIG. 1, an embodiment is illustrated that includes a plurality of fastening pins 24. A fastening pin 24 may be embedded within first mounting arm 52, second mounting arm 53, third mounting arm 54, or fourth mounting arm 55, or any combination thereof, for additional mechanical attachment of angled compliant pin interconnector 10 with a corresponding printed circuit board. As illustrated in FIG. 5, which is a cross-sectional view of one embodiment of angled compliant pin interconnector 10, fastening pin 24 may be included with insulative housing 50 by embedding embedded leg 25 within first mounting arm 52, second mounting arm 53, third mounting arm 54, and/or a fourth mounting arm 55. Such embedding may be utilized to allow free leg 26 of fastening pin 24 to project from its corresponding mounting arm 52, 53, 54, and/or 55. As such, free leg 26 may be inserted into a corresponding structure of a printed circuit board adapted for receipt of such free leg 26, thereby increasing the structural integrity of the attachment of angled compliant pin interconnected 10 with a printed circuit board.

Figure 2B:
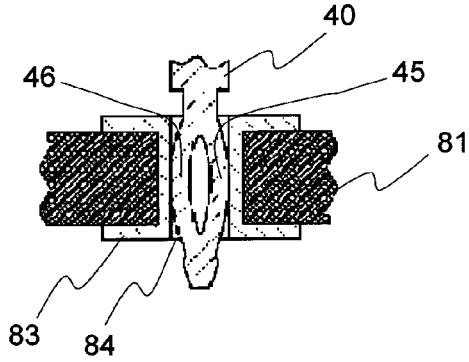
FIG. 2B is a partial cross-sectional view, taken along line D—D in FIG. 3, of a press fit pin received within a throughhole of a printed circuit board.

FIG. 2B is a partial cross-sectional view illustrating a portion of a press fit pin received within a throughhole of a printed circuit board. As shown, pin 24 includes resilient walls 45, 46, formed in an eyelet, as with pins 20 above. Specifically, leg 40 has been inserted into throughhole 84 of printed circuit board 81. So configured, walls 45, 46, being resilient, are compressed against the boundaries of conductor 83, forming an electrical and/or mechanical contact for leg 40.

Figure 3:
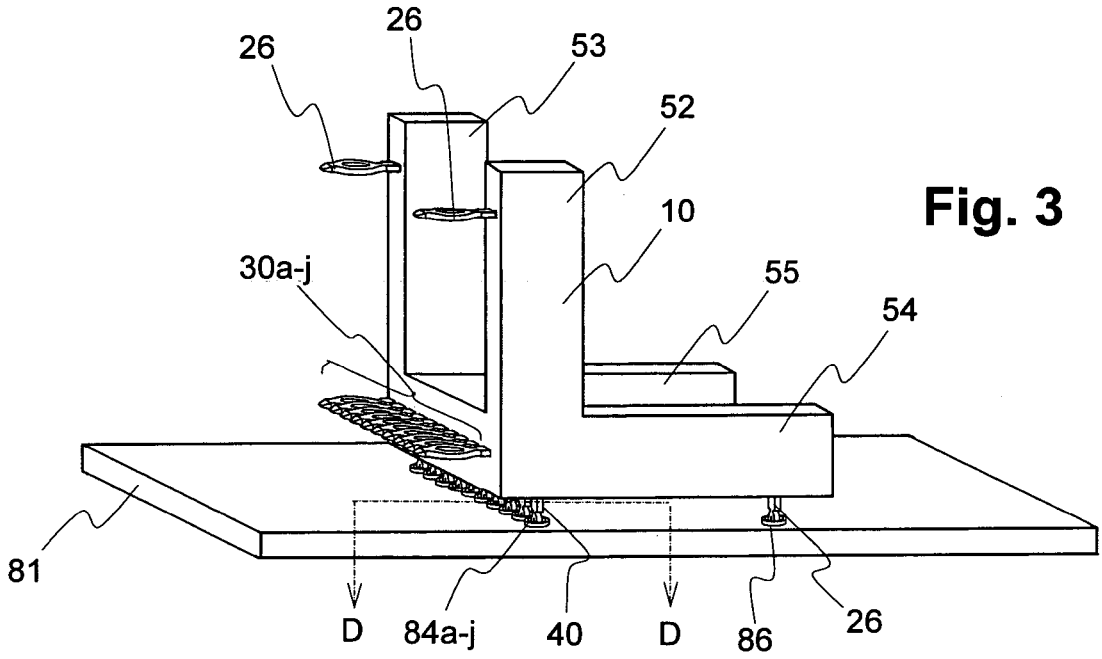
FIG. 3 is a perspective view of an angled compliant pin interconnector mounted to a first circuit board, in accordance with certain aspects of the present invention.

The presently described technology may be further understood with reference to FIG. 3. As shown in FIG. 3, angled compliant pin interconnector 10 is attached to a first printed circuit board 81. Such attachment is provided by insertion of the bed of second leg 40 of press fit pins 20*a–j* into corresponding throughholes 84*a–j* in first printed circuit board 81. Additionally, in the embodiment illustrated in FIG. 3, a free leg 26 of a fastening pin 24 carried by third mounting arm 54 has been inserted into an attachment hole 86 provided in first printed circuit board 81.

Figure 4:
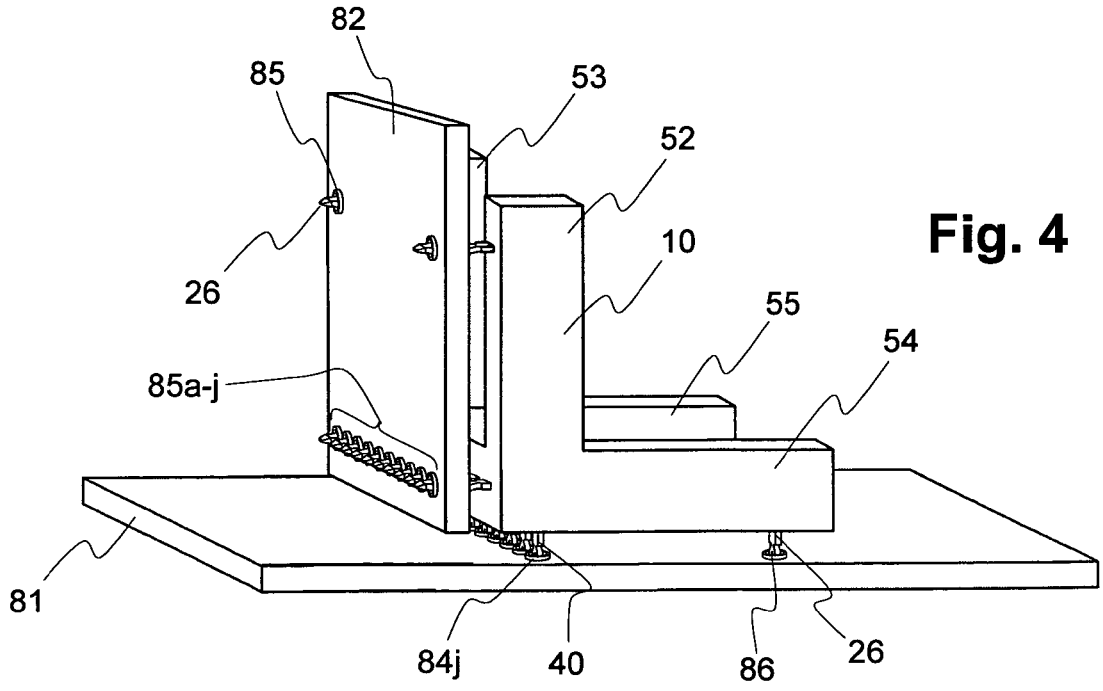
FIG. 4 is a perspective view of an angled compliant pin interconnector mounted to first and second circuit boards, the first and second circuit boards angularly oriented one to the other.

Further understanding of the presently disclosed technology may be gained with reference to FIG. 4. The embodiment illustrated in FIG. 4 may be conceptualized as the assemblage illustrated in FIG. 3 with the addition of a second printed circuit board 82 connected with the bed of first legs 30*a–j* of a plurality of press fit pins 20. As illustrated, second printed circuit board 82 has been connected to first printed circuit board 81 by use of angled compliant pin interconnector 10. Specifically, second printed circuit board 82 has been attached to the bed of plural first legs 30*a–j* illustrated in FIG. 3 by insertion of such first legs 30*a–j* into throughholes 85*a–j*. Further, second circuit board 82 also has been attached to angled compliant pin interconnector 10 by insertion of free legs 26 of the fastening pins 24 carried by first mounting arm 52 and second mounting arm 53, through throughholes 85.

Figure 6:
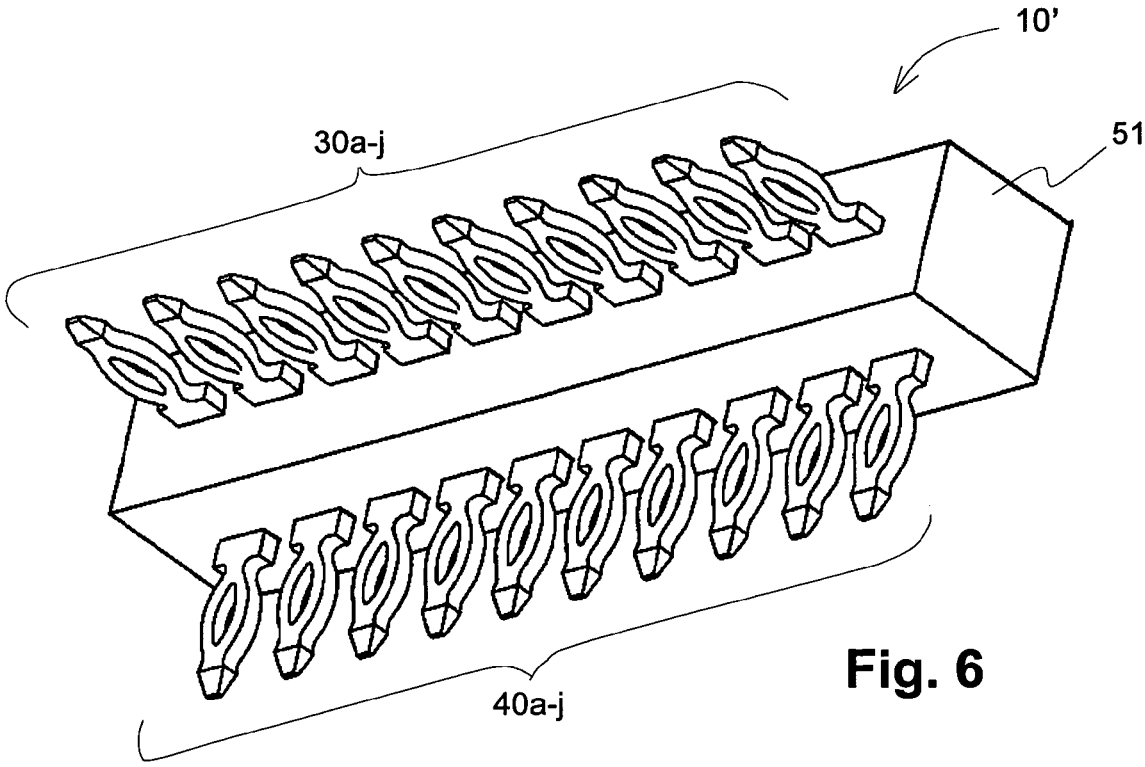
FIG. 6 is a perspective view of another embodiment of an angled compliant pin interconnector in accordance with certain aspects of the present invention.

Another embodiment of angled compliant pin interconnector generally 10 is illustrated in FIG. 6, denominated 10'. Angled compliant interconnector 10' is advantageously and economically configured for use in applications in which no need exists for mountings arms 52, 53, 54, or 55. Instead, angled compliant pin interconnector 10' carries a plurality of press fit pins 20 such that a bed of first legs 30*a–j* projects in one plane from main body 51, and a second bed of second ends 40*a–j* projects from main body 51 in a second plane that is not parallel to the plane defined by first legs 30*a–j*.

Figure 7:
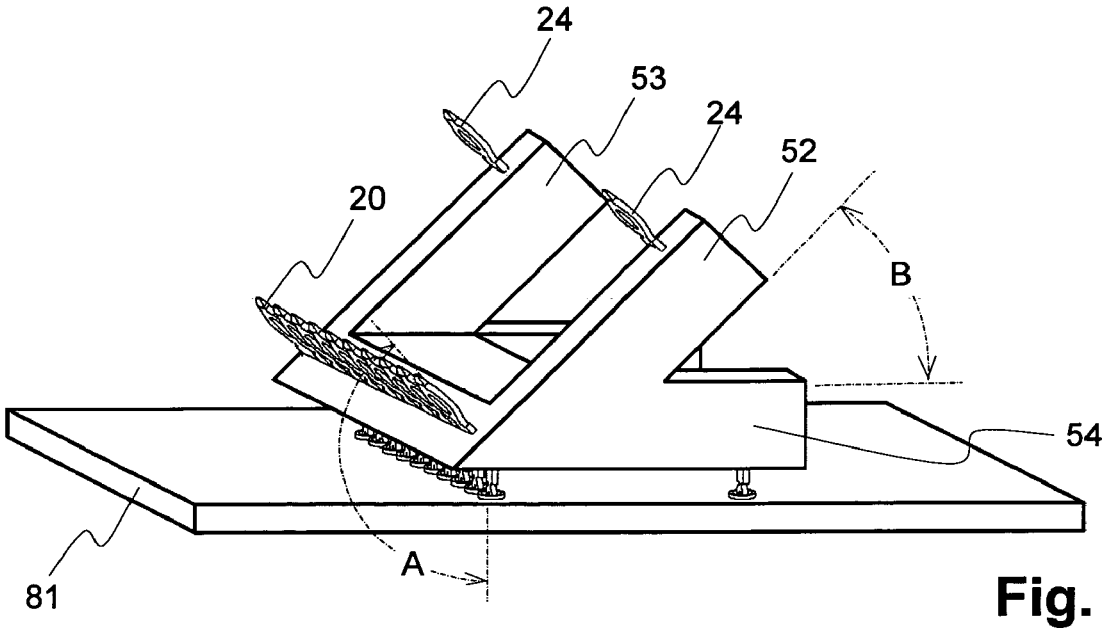
FIG. 7 is a perspective view of an angled compliant pin interconnector attached to a first circuit board, in accordance with certain aspects of the present invention.

FIG. 7 illustrates a yet still further embodiment of angled compliant pin interconnector 10. With the embodiment illustrated therein, press fit pins 20 have been configured to include angle A as an obtuse angle. So configured, the plurality of press fit pins 20*a–j* are adapted for attachment of two printed circuit boards with an acute angular orientation. As illustrated, first printed circuit board 81 has been attached to angled compliant pin interconnector 10, and angled compliant pin interconnector 10 presents a bed of second legs for attachment to a separate circuit board (not shown) that would reside at acute angle B to first printed circuit board 81. In the embodiment illustrated in FIG. 7, first and second mounting arms 52, 53 have been included, but may not be necessary in certain applications of angled compliant pin interconnector 10 with an acute angle B for angular orientation of the attached circuit boards.

Figure 8:
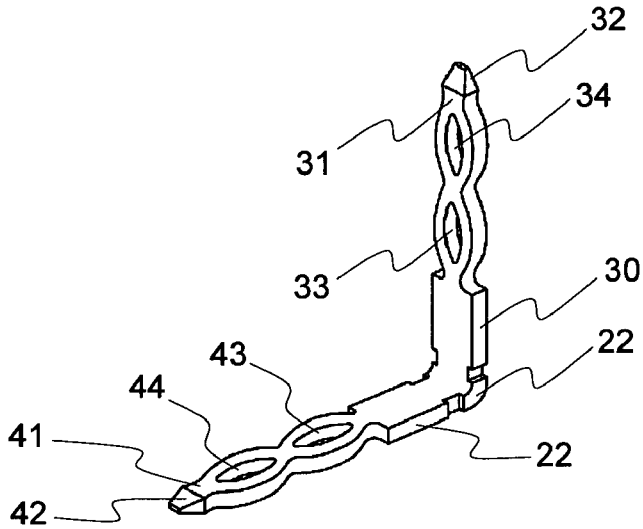
FIG. 8 is a perspective view of a V-shaped press fit pin with two eyelets on each of the legs of the pin, in accordance with certain aspects of the present invention.
Figure 9:
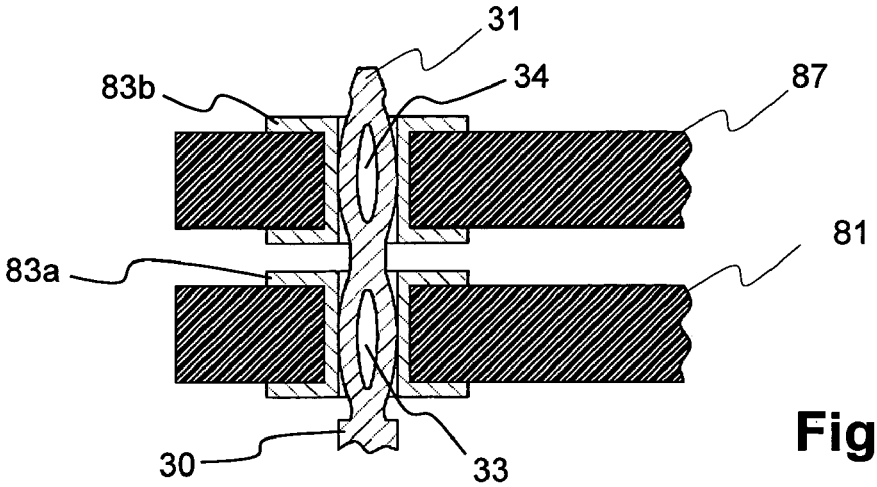
FIG. 9 is an illustrative, partial cross-sectional view of a leg of a press fit pin including two resilient eyelets, mounted through two parallel circuit boards, in accordance with certain aspects of the present invention.

FIGS. 8 and 9 illustrate a yet still additional embodiment of press fit pins 20 that may be used with an angular pin interconnector 10. As shown in FIG. 8, press fit pin 20 may include on first leg 30 a first eyelet 33, and second leg 40 may include a second eyelet 43. Additionally, though, first leg 30 may include a third eyelet 34, and fourth leg 40 may include a fourth eyelet 44. Third eyelet 44 is in serial orientation to first eyelet 33 and fourth eyelet 44 is in serial orientation to second eyelet 43. So configured, for example, first leg 30 may be inserted through two parallel circuit boards, as illustrated in FIG. 9. Specifically, first leg 30 may be inserted through a first printed circuit board 81 and into a third circuit board 87 for electrical and/or mechanical interconnection. So inserted, first eyelet 33 may establish electrical and/or mechanical connection with conductor 83*a*, while at the same time third eyelet 34 may establish electrical and/or mechanical connection with conductor 83*b*.

While the particular angled compliant pin interconnector as herein shown and described in detail is fully capable of attaining the objects of the invention, it is to be understood that it is the presently preferred embodiment of the present invention and is thus representative of the subject matter that is broadly contemplated by the present invention. It is to be further understood that the scope of the present invention fully encompasses other embodiments that may become obvious to those skilled in the art. It is intended that the present invention include such modifications and variations as come within the scope of the appended claims and their equivalents, in which reference to an element in the singular is not intended to mean "one and only one" unless explicitly so stated, but rather "one or more."

What is claimed is:

1. An angled compliant pin connector, comprising:

an insulative housing;

at least two press fit pins, each said pin including a first leg and an opposed second leg, said first leg residing on a first axis and said second leg residing on a second axis, said first and second axes intersecting to define an angle of predetermined degree, said predetermined angle degree chosen from the group consisting of a right angle and an obtuse angle, each said first and second legs defining a length, said first and second legs each defining at least one eyelet therethrough along said length, wherein a said first leg of at least one said pin defines at least two said eyelets therethrough along said length of said first leg;

said housing carrying said at least two pins parallel one to another, said first legs extending from said housing to provide a first attachment bed for electrical devices, said second legs extending from said housing to provide a second attachment bed for electrical devices.

2. An angled compliant pin connector, comprising:

an insulative housing;

at least two press fit pins, each said pin including a first leg and an opposed second leg, said first leg residing on a first axis and said second leg residing on a second axis, said first and second axes intersecting to define an angle of predetermined degree, said predetermined angle degree chosen from the group consisting of a right angle and an obtuse angle, each said first and second legs defining a length, said first and second legs each defining at least one eyelet therethrough along said length;

said housing carrying said at least two pins parallel one to another, said first legs extending from said housing to provide a first attachment bed for electrical devices, said second legs extending from said housing to provide a second attachment bed for electrical devices, wherein said insulative housing further includes a first mounting arm.

3. The angled compliant pin connector of claim 2, wherein said first mounting arm carries a press fit pin.

4. The angled compliant pin connector of claim 2, wherein said insulative housing further includes a second mounting arm.

5. The angled compliant pin connector of claim 4, wherein at least one of said first and second mounting arms carries a press fit pin.

6. The angled compliant pin connector of claim 4, wherein said first and second mounting arms residing at an acute angle one to another.

7. The angled compliant pin connector of claim 6, wherein at least one of said first and second mounting arms carries a press fit pin.

8. An angled compliant pin connector, comprising:

an insulative housing;

a plurality of elongated press fit pins, at least one of said pins electrically conductive, each said pin V-shaped, each said pin including a first end and an opposed second end wherein each said first and second ends terminate in a nib, each said pin defining a first eyelet disposed proximate to said first end and a second eyelet disposed proximate to said second end, said first and second eyelets resilient in at least one dimension; and said plurality of said elongated press fit pins carried by said insulative housing disposed generally parallel one to another, said first ends of said pins external of said insulative housing to define a first attachment plane, said second ends of said pins external of said insulative housing to define a second attachment plane, said first and second attachment planes intersecting.

9. The angled compliant pin connector of claim 8, wherein said V-shaped pins each define an obtuse angle.

10. The angled compliant pin connector of claim 8, wherein a said first leg of at least one said pin defines a second said eyelet therethrough.

11. The angled complaint pin connector of claim 8, wherein said insulative housing further includes a first mounting arm and a second mounting arm, said first and second mounting arms residing one to the other at an angle of predetermined degree, said predetermined angle degree chosen from the group consisting of a right angle and an acute angle.

12. The angled compliant pin connector of claim 11, wherein at least one of said first and second mounting arms carries a press fit pin.

13. The angled compliant pin connector of claim 8, wherein said insulative housing further includes a first mounting arm.

14. The angled compliant pin connector of claim 13, wherein said mounting arm carries a press fit pin.

15. The angled compliant pin connector of claim 13, wherein said insulative housing further includes a second mounting arm.

16. The angled compliant pin connector of claim 15, wherein at least one of said first and second mounting arms carries a press fit pin.

17. An angled compliant pin connector, comprising:

an insulative housing, said insulative housing defining a length, said insulative housing of generally polygonal cross-section along said length, said insulative housing further including a first mounting arm;

a plurality of press fit pins, said pins elongated, each said pin including a first leg and a second leg, said first and second legs joining to define a V-shape, said first and second legs defining a mid-point at such juncture, each said leg terminating in a nib;

said first leg defining a first aperture therethrough distal to said mid-point, said second leg defining a second aperture therethrough distal to said mid-point, said first and second apertures at least partially bounded by resilient walls; and said plurality of said press fit pins carried by said insulative housing along said length, said press fit pins disposed side-by-side generally parallel one to another, said first legs of said pins projecting from said insulative housing to expose said first apertures to define a first attachment plane, said second legs of said pins projecting from said insulative housing to expose said second apertures to define a second attachment plane, said first and second attachment planes intersecting.

18. The angled compliant pin connector of claim 17, wherein said V-shape defines a right angle.

19. The angled compliant pin connector of claim 17, wherein said V-shape defines an obtuse angle.

20. The angled compliant pin connector of claim 17, wherein a said first leg of at least one said pin defines a second said eyelet therethrough.

21. The angled compliant pin connector of claim 17, wherein all of said press fit pins are electrically conductive from said first leg to said second leg.

22. The angled compliant pin connector of claim 21, wherein said first mounting arm carries a press fit pin.

23. The angled complaint pin connector of claim 17, wherein said insulative housing further includes a second mounting arm.

24. The angled complaint pin connector of claim 23, wherein at least one of said first and second mounting arms carries a press fit pin.

25. The angled compliant pin connector of claim 17, wherein said insulative housing further includes second mounting arm, said first and second mounting arms residing one to the other at an angle of predetermined degree, said predetermined angle degree chosen from the group consisting of a right angle and an acute angle.

26. The angled compliant pin connector of claim 25, wherein at least one of said first and second mounting arms carries a press fit pin.

27. An angled complaint pin connector, comprising:

a plurality of V-shaped press fit pins each including a first leg and a second leg, said first leg including first resilient connecting means for connecting said leg to a throughhole of an electrical device; said second leg including second resilient connecting means for connecting said leg to a throughhole of an electrical device, wherein said V-shape defines an obtuse angle;

housing means for housing said plurality of press fit pins side-by-side generally parallel one to another, said first and second resilient connecting means projecting from said housing means, said housing means further including mounting means for mounting said housing means on a circuit board.

28. An angled complaint pin connector, comprising:

a plurality of V-shaped press fit pins each including a first leg and a second leg, said first leg including first resilient connecting means for connecting said leg to a throughhole of an electrical device and further including second resilient connecting means; said second leg including second resilient connecting means for connecting said leg to a throughhole of an electrical device;

housing means for housing said plurality of press fit pins side-by-side generally parallel one to another, said first and second resilient connecting means projecting from said housing means, said housing means further including mounting means for mounting said housing means on a circuit board.

* * * * *